US010844323B2

(12) United States Patent
Weber et al.

(10) Patent No.: US 10,844,323 B2
(45) **Date of Patent: *Nov. 24, 2020**

(54) FORMULATIONS, THE PRODUCTION AND USE THEREOF, AND SUITABLE COMPONENTS

(71) Applicant: BASF SE, Ludwigshafen am Rhein (DE)

(72) Inventors: Heike Weber, Ludwigshafen (DE); Holger Tuerk, Ludwigshafen (DE); Gazi Tuerkoglu, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 59 days.

This patent is subject to a terminal disclaimer.

(21) Appl. No.: 16/096,841

(22) PCT Filed: Apr. 18, 2017

(86) PCT No.: PCT/EP2017/059089
§ 371 (c)(1),
(2) Date: Oct. 26, 2018

(87) PCT Pub. No.: WO2017/186524
PCT Pub. Date: Nov. 2, 2017

(65) Prior Publication Data

US 2019/0136152 A1 May 9, 2019

(30) Foreign Application Priority Data

Apr. 27, 2016 (EP) ..... 16167309

(51) Int. Cl.

| | |
|---|---|
| ***C11D 3/33*** | (2006.01) |
| ***C11D 3/37*** | (2006.01) |
| ***C11D 11/00*** | (2006.01) |
| ***B08B 3/04*** | (2006.01) |
| ***C11D 3/20*** | (2006.01) |
| *C11D 1/825* | (2006.01) |
| *C11D 3/39* | (2006.01) |

(52) U.S. Cl.
CPC ..... *C11D 3/2086* (2013.01); *C11D 3/33* (2013.01); *C11D 3/3788* (2013.01); *C11D 11/0035* (2013.01); *C11D 1/825* (2013.01); *C11D 3/3942* (2013.01)

(58) Field of Classification Search
CPC ..... C11D 3/042; C11D 3/226; C11D 3/33; C11D 3/37; C11D 3/3788; C11D 11/00; B08B 3/04
See application file for complete search history.

(56) References Cited

U.S. PATENT DOCUMENTS

| | | | | |
|---|---|---|---|---|
| 6,462,006 | B1 | 10/2002 | Sorg et al. | |
| 8,354,368 | B2 | 1/2013 | Schunicht et al. | |
| 10,072,235 | B2 | 9/2018 | Türk et al. | |
| 10,294,444 | B2 * | 5/2019 | Turk | C11D 3/2086 |
| 2011/0118168 | A1 * | 5/2011 | Schunicht | C08F 251/00 510/400 |
| 2017/0130168 | A1 * | 5/2017 | Turk | C11D 3/3788 |
| 2017/0145352 | A1 | 5/2017 | Türk et al. | |

FOREIGN PATENT DOCUMENTS

| | | | | |
|---|---|---|---|---|
| DE | 4316746 | A1 | 11/1994 | |
| DE | 19819187 | A | 11/1999 | |
| EP | 0851023 | A2 | 7/1998 | |
| EP | 2138560 | A1 | 12/2009 | |
| WO | 2011066206 | A1 | 6/2011 | |
| WO | 2015197378 | A1 | 12/2015 | |
| WO | 2015197379 | A1 | 12/2015 | |
| WO | WO 2015/197379 | * | 12/2015 | C07C 227/18 |

OTHER PUBLICATIONS

European Search Report for EP Patent Application No. 16167309.0, dated Nov. 3, 2016, 3 pages.
International Search Report issued in PCT/EP2017/059089, dated Jul. 26, 2017, 2 pages.

* cited by examiner

*Primary Examiner* — Brian P Mruk
(74) *Attorney, Agent, or Firm* — Armstrong Teasdale LLP

(57) ABSTRACT

Described herein is a formulation including (A) citric acid or an alkali metal salt of citric acid, (B) at least one graft copolymer formed from (a) at least one graft base selected from nonionic monosaccharides, disaccharides, oligosaccharides and polysaccharides, and side chains, obtainable by grafting of (b) at least one ethylenically unsaturated mono- or dicarboxylic acid and (c) at least one compound of the general formula (I)

(I)

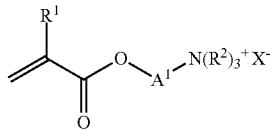

where the variables are defined as follows:

$R^1$ is selected from methyl and hydrogen, $A^1$ is selected from $C_2$-$C_4$-alkylene, $R^2$ are the same or different and are selected from $C_1$-$C_1$-alkyl, $X^-$ is selected from halide, mono-$C_1$-$C_4$-alkylsulfate and sulfate, (C) a total of zero to 0.5% by weight of methylglycinediacetic acid (MGDA) and glutaminediacetic acid (GLDA) and alkali metal salts of MGDA and GLDA.

14 Claims, No Drawings

FORMULATIONS, THE PRODUCTION AND USE THEREOF, AND SUITABLE COMPONENTS

CROSS-REFERENCE TO RELATED APPLICATIONS

This application is the national stage entry of PCT/EP2017/059089, filed on Apr. 18, 2017, which claims the benefit of priority to European Patent Application No. 16167309.0, filed Apr. 27, 2016, each of which is incorporated by reference in its entirety herein.

BACKGROUND OF THE INVENTION

The present application relates to formulations comprising (A) citric acid or an alkali metal salt of citric acid, (B) at least one graft copolymer formed from (a) at least one graft base selected from nonionic monosaccharides, disaccharides, oligosaccharides and polysaccharides, and side chains, obtainable by grafting of (b) at least one ethylenically unsaturated mono- or dicarboxylic acid and (c) at least one compound of the general formula (I)

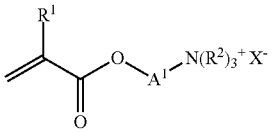

(I)

where the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate, (C) a total of zero to 0.5% by weight of methylglycinediacetic acid (MGDA) and glutaminediacetic acid (GLDA) and alkali metal salts of MGDA and GLDA.

Dishwashing compositions have to fulfill a variety of demands. For instance, they have to thoroughly clean the dishware, they should not include any harmful or potentially harmful substances in the wastewater, they should permit the water to run off and dry from the dishware, and the detached soil constituents must be dispersed or emulsified in such a sustained manner that they are not deposited on the surface of the ware. The dishwashing compositions should not lead to problems in the operation of the machine dishwasher. Finally, they should not lead to esthetically undesirable consequences on the ware to be cleaned. More particularly, there should be no occurrence of whitish spots or deposits which arise because of the presence of lime or other inorganic and organic salts on drying of water droplets or are precipitated on the ware as a result of deposition of soil constituents or inorganic salts during the washing operation.

Especially in modern machine dishwashing detergents, the multifunctional detergents (e.g. 3-in-1 detergents or generally x-in-1 detergents), the functions of cleaning, of rinsing and of water softening are combined in a single detergent formulation, and so there is no need for the user to replenish salt (at water hardnesses of 0° to 21° dH) or to replenish rinse aid.

In x-in-1 detergents, polymers are frequently used for inhibition of scale. In phosphate-containing detergents, these may, for example, be sulfonate-containing polymers, which especially show effects on the inhibition of calcium phosphate deposits. The surfactants used are chosen such that they are entrained into the rinse cycle and ensure optimal wetting and a good rinsing result therein. Further suitable polymers are polycarboxylates, for example polyacrylic acids.

However, the trend toward phosphate-free cleaning compositions which are also still to be used without rinse aid and ion exchanger is requiring new solutions. In phosphate-free dishwashing compositions, the composition of the salts obtained is different than in phosphate-containing detergents, and so polymers used to date in many cases have insufficient efficacy. Especially with regard to the inhibition of scale, phosphate-free dishwashing compositions are still in need of improvement.

EP 2 138 560 A1 discloses graft copolymers and the use thereof in compositions for cleaning of hard surfaces, including as dishwashing detergents. However, the cleaning compositions disclosed in EP 2 138 560 A1 do not have adequate inhibition of scale in some cases, for example as dishwashing compositions on items of cutlery such as knives and especially on glass.

WO 2015/197379 discloses formulations comprising a graft copolymer and additionally a builder selected from MGDA and GLDA and salts thereof. The formulations disclosed do exhibit good inhibition of scale—especially in phosphate-free compositions and especially on glass. However, a tendency to glass corrosion is observed in some cases, especially in the case of repeated washing operations in machine dishwashers.

The problem addressed was therefore that of providing formulations having very good inhibition of scale—especially in phosphate-free compositions—especially on glass. A further problem addressed was that of providing a process by which formulations having very good inhibition of scale—especially in phosphate-free compositions—can be produced. A final problem addressed was that of providing suitable components for formulations of this kind.

DETAILED DESCRIPTION OF THE INVENTION

Accordingly, the formulations defined at the outset have been found, and these are also referred to in the context of the present invention as formulations of the invention.

Formulations of the invention may be in solid, liquid, paste or gel form at room temperature, i.e. at 20° C. Preferably, formulations of the invention are solid at room temperature. Formulations of the invention that are solid at room temperature may be anhydrous or comprise water, for example up to 20% by weight, preferably 0.1% to 10% by weight of water, determinable, for example, by Karl Fischer titration or by determination of the dry residue at 80° C. under reduced pressure. Formulations of the invention that are solid at room temperature may take the form, for example, of powder, granules or tablets.

In another embodiment, formulations of the invention are liquid at 20° C. Formulations of the invention that are liquid at 20° C. may comprise 30% to 80% by weight of water, preferably 40% to 80% by weight. In such embodiments too, the water content can be determined by determining the dry residue at 80° C. under reduced pressure. Formulations of the invention that are liquid at room temperature may, for example, be in gel form.

Formulations of the invention comprise (A) at least one compound, also called compound (A) for short, selected from citric acid and alkali metal salts thereof. Preferably, compound (A) is selected from the sodium salts and potassium salts of citric acid and from mixed sodium-potassium salts of citric acid. Examples are trisodium citrate ("sodium citrate"), tripotassium citrate ("potassium citrate"), disodium monopotassium citrate, dipotassium monosodium citrate and disodium citrate.

Citric acid itself and salts of citric acid are generally in the form of hydrates. For example, sodium citrate under standard conditions is generally in dihydrate form, and potassium citrate in monohydrate form. Unless explicitly stated otherwise, in the context of the present invention, stated amounts in connection with compound (A) always relate to the active ingredient, i.e. do not take account of hydrate.

Formulations of the invention comprise only a small amount of MGDA and salts thereof, if any. Formulations of the invention comprise only a small amount of GLDA and salts thereof, if any. Specifically, formulations of the invention comprise (C) zero to a maximum of 0.5%, preferably zero to 0.1% by weight, of methylglycinediacetic acid (MGDA) and glutaminediacetic acid (GLDA) and alkali metal salts of MGDA and GLDA. It is unimportant in the context of the present invention whether MGDA or GLDA or the corresponding salts are in enantiomerically pure or racemic form or in the form of an enantiomerically enriched mixture.

GLDA and MGDA and alkali metal salts thereof may be in the form of hydrates. Unless explicitly stated otherwise, in the context of the present invention, stated amounts in connection with MGDA or GLDA or the alkali metal salts thereof always relate to the active ingredient, i.e. do not take account of hydrate.

Formulations of the invention further comprise (B) at least one graft copolymer, which is also referred to in the context of the present invention as graft copolymer (B) or inventive graft copolymer (B), and is formed from (a) at least one graft base, called graft base (a) for short, selected from nonionic monosaccharides, disaccharides, oligosaccharides and polysaccharides, and side chains, obtainable by grafting of (b) at least one ethylenically unsaturated mono- or dicarboxylic acid, called monocarboxylic acid (b) or dicarboxylic acid (b) for short, and (c) at least one compound of the general formula (I), called monomer (c) or compound (c) or compound (I) for short, (I)

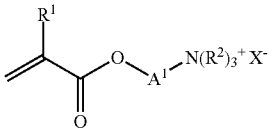

where the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate.

Nonionic monosaccharides suitable as graft base (a) that are selected may, for example, be aldopentoses, pentuloses (ketopentoses), aldohexoses and hexuloses (ketohexoses). Suitable aldopentoses are, for example, D-ribose, D-xylose and L-arabinose. Aldohexoses include D-glucose, D-mannose and D-galactose; examples of hexuloses (ketohexoses) particularly include D-fructose and D-sorbose.

In the context of the present invention, deoxy sugars, for example L-fucose and L-rhamnose, should also be counted among the nonionic monosaccharides.

Examples of nonionic disaccharides include, for example, cellobiose, lactose, maltose and sucrose.

Nonionic oligosaccharides in the context of the present invention shall refer to nonionic carbohydrates having three to ten nonionic monosaccharide units per molecule, for example glycans. Nonionic polysaccharides in the context of the present invention refer to nonionic carbohydrates having more than ten nonionic monosaccharide units per molecule. Nonionic oligo- and polysaccharides may, for example, be linear, branched or cyclic.

Examples of nonionic polysaccharides include biopolymers such as starch and glycogen, and cellulose and dextran. These further include inulin as a polycondensate of D-fructose (fructans) and chitin. Further examples of nonionic polysaccharides are nonionic starch degradation products, for example products which can be obtained by enzymatic or what is called chemical degradation of starch. One example of the chemical degradation of starch is acid-catalyzed hydrolysis.

Preferred examples of nonionic starch degradation products are maltodextrins. Maltodextrin in the context of the present invention covers mixtures of monomers, dimers, oligomers and polymers of glucose. The percentage composition differs according to the degree of hydrolysis. The percentage composition is defined in terms of the dextrose equivalent, which is between 3 and 40 in the case of maltodextrin.

Preferably, graft base (a) is selected from nonionic polysaccharides, especially from starch which has preferably not been chemically modified, for example wherein the hydroxyl groups have preferably been neither esterified nor etherified. In one embodiment of the present invention, starch is selected from those nonionic polysaccharides having in the range from 20% to 30% by weight of amylose and in the range from 70% to 80% amylopectin. Examples are corn starch, rice starch, potato starch and wheat starch.

Side chains have been grafted onto the graft base (a). For every molecule of graft copolymer (B), preferably an average of one to ten side chains can be grafted on. Preferably, one side chain is joined to the anomeric carbon atom of a monosaccharide or to an anomeric carbon atom of the chain end of an oligo- or polysaccharide. The upper limit in the number of side chains arises from the number of carbon atoms having hydroxyl groups in the graft base (a) in question.

Examples of monocarboxylic acids (b) are ethylenically unsaturated $C_3$-$C_{10}$-monocarboxylic acids and the alkali metal or ammonium salts thereof, especially the potassium and sodium salts. Preferred monocarboxylic acids (b) are acrylic acid and methacrylic acid, and also sodium (meth) acrylate. Mixtures of ethylenically unsaturated $C_3$-$C_{10}$ monocarboxylic acids and especially mixtures of acrylic acid and methacrylic acid are also preferred components (b).

Examples of dicarboxylic acids (b) are ethylenically unsaturated $C_4$-$C_{10}$-dicarboxylic acids and the mono- and especially dialkali metal or ammonium salts thereof, especially the dipotassium and disodium salts, and anhydrides of ethylenically unsaturated $C_4$-$C_{10}$-dicarboxylic acids. Preferred dicarboxylic acids (b) are maleic acid, fumaric acid, itaconic acid, and also maleic anhydride and itaconic anhydride.

In one embodiment, graft copolymer (B) comprises, in at least one side chain, as well as monomer (c), at least one monocarboxylic acid (b) and at least one dicarboxylic acid (b). In a preferred embodiment of the present invention, graft copolymer (B) comprises, in the side chains, aside from monomer (c), exclusively copolymerized monocarboxylic acid (b) and no dicarboxylic acid (b).

Monomers (c) are ethylenically unsaturated N-containing compounds having a permanent cationic charge.

(I)

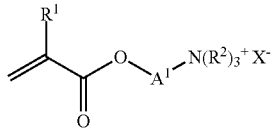

where the variables are defined as follows:

$R^1$ is selected from methyl and hydrogen, $A^1$ is selected from $C_2$-$C_4$-alkylene, for example —$CH_2$—$CH_2$—, $CH_2$—$CH(CH_3)$—, —$(CH_2)_3$—, —$(CH_2)_4$—, preference being given to —$CH_2$—$CH_2$— and —$(CH_2)_3$—, $R^2$ are different or preferably the same and are selected from $C_1$-$C_4$-alkyl, for example methyl, ethyl, n-propyl, n-butyl, isopropyl, isobutyl, sec-butyl, tert-butyl; preferably at least two $R^2$ are the same and are each methyl, and the third $R^2$ group is ethyl, n-propyl or n-butyl, or two $R^2$ are the same and are each ethyl, and the third $R^2$ group is methyl, n-propyl or n-butyl. More preferably, all three $R^2$ are each the same and are selected from methyl.

$X^-$ is selected from halide, for example bromide, iodide and especially chloride, and also from mono-$C_1$-$C_4$-alkylsulfate and sulfate. Examples of mono-$C_1$-$C_4$-alkylsulfate are methylsulfate, ethylsulfate, isopropylsulfate and n-butylsulfate, preferably methylsulfate and ethylsulfate. When $X^-$ is selected as sulfate, $X^-$ is half an equivalent of sulfate.

In a preferred embodiment of the present invention, the variables in monomer (c) are selected as follows:

$R^1$ is hydrogen or methyl, $R^2$ are the same and are each methyl, $A^1$ is $CH_2CH_2$, and $X^-$ is chloride.

In one embodiment of the present invention, monomer (c) is selected from

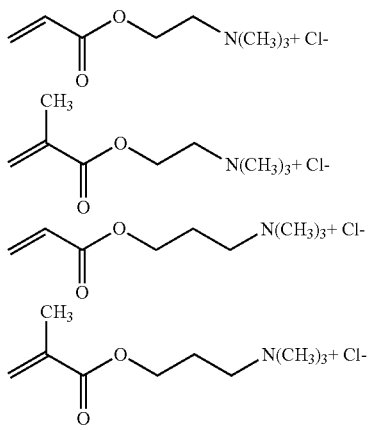

Graft copolymer (B) may comprise, in one or more side chains, at least one further copolymerized comonomer (d), for example hydroxyalkyl ester such as 2-hydroxyethyl (meth)acrylate or 3-hydroxypropyl (meth)acrylate, or ester of alkoxylated fatty alcohols, or sulfo-containing comonomers, for example 2-acrylamido-2-methylpropanesulfonic acid (AMPS) and the alkali metal salts thereof.

Preferably, graft copolymer (B), apart from monomer (c) and monocarboxylic acid (b) or dicarboxylic acid (b), does not comprise any further comonomers (d) in one or more side chains.

In one embodiment of the present invention, the proportion of graft base (a) in graft copolymer (B) is in the range from 40% to 95% by weight, preferably from 50% to 90% by weight, based in each case on overall graft copolymer (B).

In one embodiment of the present invention, the proportion of monocarboxylic acid (b) or dicarboxylic acid (b) is in the range from 2% to 40% by weight, preferably from 5% to 30% by weight and especially from 5% to 25% by weight, based in each case on overall graft copolymer (B).

Monomer or monomers (c) is/are copolymerized in amounts of 5% to 50% by weight, preferably of 5% to 40% by weight and more preferably of 5% to 30% by weight, based in each case on overall graft copolymer (B).

It is preferable when graft copolymer (B) comprises more copolymerized monocarboxylic acid (b) than monomer (c), and based on the molar proportions, for example, in the range from 1.1:1 to 5:1, preferably 2:1 to 4:1.

In one embodiment of the present invention, the mean molecular weight ($M_w$) of graft copolymer (B) is in the range from 1500 to 200 000 g/mol, preferably from 2000 to 150 000 and especially in the range from 3000 to 100 000 g/mol. The mean molecular weight $M_w$ is preferably measured by gel permeation chromatography in aqueous KCl/formic acid solution.

Graft copolymer (B) can preferably be obtained as an aqueous solution from which it can be isolated, for example by spray drying, spray granulation or freeze-drying. Optionally, solution of graft copolymer (B) or dried graft copolymer (B) can be used for production of the formulations of the invention.

It is preferable to stabilize graft copolymer (B) with at least one biocide. Examples of suitable biocides are isothiazolinones, for example 1,2-benzisothiazolin-3-one ("BIT"), octylisothiazolinone ("OIT"), dichlorooctylisothiazolinone ("DCOIT"), 2-methyl-2H-isothiazolin-3-one ("MIT") and 5-chloro-2-methyl-2H-isothiazolin-3-one ("CIT"), phenoxyethanol, alkylparabens such as methylparaben, ethylparaben, propylparaben, benzoic acid and its salts, for example sodium benzoate, benzyl alcohol, alkali metal sorbates, for example sodium sorbate, and optionally substituted hydantoins, for example 1,3-bis(hydroxymethyl)-5,5-dimethylhydantoin (DMDM hydantoin). Further examples are 1,2-dibromo-2,4-dicyanobutane, iodo-2-propynyl butyl carbamate, iodine and iodophors.

In one embodiment of the present invention, the formulation of the invention is free of phosphates and polyphosphates, including hydrogenphosphates, for example free of trisodium phosphate, pentasodium tripolyphosphate and hexasodium metaphosphate. "Free of" in connection with phosphates and polyphosphates shall be understood in the context of the present invention to mean that the total content of phosphates and polyphosphates is in the range from 10 ppm to 0.2% by weight, determined by gravimetry.

In one embodiment of the present invention, the formulation of the invention is free of those heavy metal compounds that do not act as bleach catalysts, especially of compounds of iron. "Free of" in connection with heavy metal compounds shall be understood in the context of the present invention to mean that the total content of heavy metal compounds that do not act as bleach catalysts is in the range from 0 to 100 ppm, preferably 1 to 30 ppm, determined by the Leach method.

"Heavy metals" in the context of the present invention are considered to be all metals having a specific density of at least 6 g/cm$^3$, except for zinc and bismuth. Heavy metals are especially considered to be precious metals, and also iron, copper, lead, tin, nickel, cadmium and chromium.

In one embodiment of the present invention, formulation of the invention comprises a total of in the range from 1% to 50% by weight of compound (A), preferably 5% to 45% by weight, more preferably 10% to 35% by weight;

a total of in the range from 0.1% to 4% by weight of graft copolymer (B), preferably 0.2% to 2% by weight, more preferably 0.3% to 1.0% by weight, based in each case on solids content of the formulation of the invention in question.

Formulations of the invention may be free of bleaches, for example free of inorganic peroxide compounds or chlorine bleaches such as sodium hypochlorite. "Free of inorganic peroxide compounds or chlorine bleaches" shall be understood to mean that such formulations of the invention comprise a total of 0.01% by weight or less of inorganic peroxide compound and chlorine bleach, based in each case on solids content of the formulation of the invention in question.

In another embodiment of the present invention, formulation of the invention comprises (D) at least one inorganic peroxide compound, also referred to in the context of the present invention as peroxide (D) for short. Peroxide (D) is selected from sodium peroxodisulfate, sodium perborate and sodium percarbonate, preferably sodium percarbonate.

Peroxide (D) may be anhydrous or preferably aqueous. An example of aqueous sodium perborate is $Na_2[B(OH)_2(O_2)]_2$, sometimes also written as $NaBO_2.O_2.3H_2O$. An example of aqueous sodium percarbonate is 2 $Na_2CO_3.3H_2O_2$. More preferably, peroxide (D) is selected from aqueous percarbonates.

Percarbonates and especially sodium percarbonate are preferably used in coated form. The coating may be inorganic or organic in nature. Examples of coating materials are glycerol, sodium sulfate, silica gel, sodium silicate, sodium carbonate and combinations of at least two of the above coating materials, for example sodium carbonate and sodium sulfate.

Preferably, formulation of the invention comprises in the range from 1% to 20% by weight of peroxide (D), preferably 2% to 12% by weight, more preferably 3% to 12% by weight, based on solids content of the formulation in question.

Formulations of the invention which comprise at least one peroxide (D) are preferably solid at room temperature.

In another embodiment, formulation of the invention comprises (D) at least one chlorine-containing bleach, which is also referred to in the context of the present invention as chlorine bleach (D) for short. Chlorine bleach (D) is preferably sodium hypochlorite.

Formulations of the invention that contain chlorine bleach (D) are preferably liquid at room temperature.

Preferably, formulation of the invention comprises in the range from 0.1% to 20% by weight of chlorine bleach (D), preferably 0.5% to 12% by weight, more preferably 1% to 12% by weight, based on solids content of the liquid formulation in question.

Formulations of the invention may comprise one or more further ingredients (E). Ingredients (F) are different than compound (A), graft copolymer (B) and peroxide (D) or chlorine bleach (D).

Formulations of the invention may include one or more further ingredients (E), for example one or more surfactants, one or more enzymes, one or more enzyme stabilizers, one or more builders, especially phosphate-free builders, one or more cobuilders, one or more alkali carriers, one or more acids, one or more bleach catalysts, one or more bleach activators, one or more bleach stabilizers, one or more defoamers, one or more corrosion inhibitors, one or more builder materials, buffers, dyes, one or more fragrances, one or more thickeners, one or more organic solvents, one or more tableting aids, one or more disintegrants, also called tablet disintegrants, or one or more solubilizers.

Examples of surfactants are especially nonionic surfactants and mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide, and reaction products of sorbitan with ethylene oxide or propylene oxide, alkyl glycosides, and what are called amine oxides.

Preferred examples of alkoxylated alcohols and alkoxylated fatty alcohols are compounds of the general formula (IV)

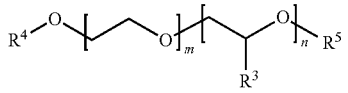

(IV)

in which the variables are defined as follows:

$R^3$ are the same or different and are selected from linear $C_1$-$C_{10}$-alkyl, preferably ethyl and more preferably methyl, $R^4$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, or mixtures of two or more of the alkyl radicals above, $R^5$ is selected from hydrogen and $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Compounds of the general formula (IV) may be block copolymers or random copolymers, preferably block copolymers.

Other preferred examples of alkoxylated alcohols and alkoxylated fatty alcohols are compounds of the general formula (V)

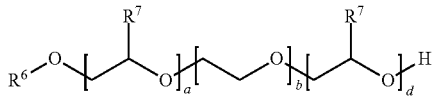

(V)

in which the variables are defined as follows:

$R^6$ is selected from $C_6$-$C_{20}$-alkyl, especially n-$C_8H_{17}$, n-$C_{10}H_{21}$, n-$C_{12}H_{25}$, n-$C_{14}H_{29}$, n-$C_{16}H_{33}$, n-$C_{18}H_{37}$, $R^7$ are the same or different and are selected from linear $C_1$-$C_4$-alkyl, and are preferably each the same and are ethyl and more preferably methyl.

a is a number in the range from 1 to 6, b is a number in the range from 4 to 20, d is a number in the range from 4 to 25.

Compounds of the general formula (V) may be block copolymers or random copolymers, preferably block copolymers.

Other preferred examples of alkoxylated alcohols and alkoxylated fatty alcohols are hydroxy mixed ethers of the general formula (VI)

$$R^8—CH(OH)—CH_2—O-(AO)_k-R^9 \quad (VI)$$

where the variables are selected as follows:

$R^8$ $C_4$-$C_{30}$-alkyl, branched or unbranched, or $C_4$-$C_3$O-alkenyl, branched or unbranched, having at least one C—C double bond.

Preferably, $R^8$ is selected from $C_4$-$C_{30}$-alkyl, branched or unbranched, more preferably unbranched $C_4$-$C_{30}$-alkyl and most preferably n-$C_{10}$-$C_{12}$-alkyl.

$R^9$ $C_1$-$C_{30}$-alkyl, branched or unbranched, or $C_2$-$C_{30}$-alkenyl, branched or unbranched, having at least one C—C double bond.

Preferably, $R^9$ is selected from $C_4$-$C_{30}$-alkyl, branched or unbranched, more preferably unbranched $C_6$-$C_{20}$-alkyl and most preferably n-$C_8$-$C_{11}$-alkyl.

k is a number in the range from 1 to 100, preferably from 5 to 60, more preferably 10 to 50 and most preferably 15 to 40, AO is selected from alkylene oxide, different or the same, and selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O. A preferred example of AO is $CH_2$—$CH_2$-0 (EO).

In one embodiment of the present invention, $(AO)_k$ is selected from $(CH_2CH_2O)_{k1}$ where k1 is selected from numbers in the range from 1 to 50.

In one embodiment of the present invention, $(AO)_k$ is selected from —$(CH_2CH_2O)_{k2}$—$(CH_2CH(CH_3)$—$O)_{k3}$ and —$(CH_2CH_2O)_{k2}$—$(CH(CH_3)CH_2$—$O)_{x3}$ where k2 and k3 may be the same or different and are selected from numbers in the range from 1 to 30.

In one embodiment of the present invention, $(AO)_k$ is selected from —$(CH_2CH_2O)_{k4}$ where k4 is in the range from 10 to 50, AO is EO, and $R^8$ and $R^9$ are selected independently from $C_8$-$C_{14}$-alkyl.

In the context of the present invention, k and k1, k2, k3 and k4 are each understood to mean averages, preferably the numerical average. Therefore, each of the variables k and k1, k2, k3 or k4—if present—can mean a fraction. A particular molecule may of course always bear just a whole number of AO units.

Further examples of suitable nonionic surfactants are compounds of the general formula (VII) and especially of the formula (VII a)

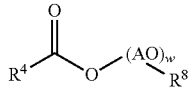

(VII)

-continued

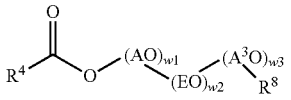

(VII a)

where $R^4$ and AO are as defined above and EO is ethylene oxide, i.e. $CH_2CH_2O$, where the AO in formula (VII) and (VII a) may each be the same or different, $R^8$ is selected from $C_8$-$C_{18}$-alkyl, linear or branched, $A^3O$ is selected from propylene oxide and butylene oxide, w is a number in the range from 15 to 70, preferably 30 to 50, w1 and w3 are numbers in the range from 1 to 5 and w2 is a number in the range from 13 to 35.

Further suitable nonionic surfactants are selected from di- and multiblock copolymers formed from ethylene oxide and propylene oxide. Further suitable nonionic surfactants are selected from ethoxylated or propoxylated sorbitan esters. Likewise suitable are amine oxides or alkyl glycosides. An overview of suitable further nonionic surfactants can be found in EP-A 0 851 023 and in DE-A 198 19 187.

It is also possible for mixtures of a plurality of various nonionic surfactants to be present.

Examples of nonionic surfactants are $C_8$-$C_{20}$-alkylsulfates, $C_8$-$C_2$O-alkylsulfonates and $C_8$-$C_{20}$-alkyl ether sulfates having one to 6 ethylene oxide units per molecule.

In one embodiment of the present invention, formulation of the invention may comprise in the range from 3% to 20% by weight of surfactant.

Formulations of the invention may comprise one or more enzymes. Examples of enzymes are lipases, hydrolases, amylases, proteases, cellulases, esterases, pectinases, lactases and peroxidases.

Formulations of the invention may comprise, for example, up to 5% by weight of enzyme, preferably 0.1% to 3% by weight, based in each case on total solids content of the formulation of the invention.

Formulations of the invention may comprise one or more enzyme stabilizers. Enzyme stabilizers serve for protection of enzyme—particularly during storage—against damage, for example inactivation, denaturing or breakdown, for instance as a result of physical influences, oxidation or proteolytic cleavage.

Examples of enzyme stabilizers are reversible protease inhibitors, for example benzamidine hydrochloride, borax, boric acids, boronic acids or the salts or esters thereof, including in particular derivatives with aromatic groups, for instance ortho-, meta- or para-substituted phenylboronic acids, especially 4-formylphenylboronic acid, or the salts or esters of the aforementioned compounds. Also used for this purpose are peptide aldehydes, i.e. oligopeptides with a reduced C terminus, especially those composed of 2 to 50 monomers. The peptidic reversible protease inhibitors include ovomucoid and leupeptin. Also suitable for this purpose are specific reversible peptide inhibitors for the protease subtilisin, and fusion proteins composed of proteases and specific peptide inhibitors.

Further examples of enzyme stabilizers are amino alcohols such as mono-, di-, triethanol- and -propanolamine and mixtures thereof, aliphatic mono- and dicarboxylic acids up to $C_{12}$-carboxylic acids, for example succinic acid. End group-capped fatty acid amide alkoxylates are also suitable enzyme stabilizers.

Other examples of enzyme stabilizers are sodium sulfite, reducing sugars and potassium sulfate. Another example of a suitable enzyme stabilizer is sorbitol.

Formulations of the invention may comprise one or more builders (E), especially phosphate-free builders (E). In the context of the present invention, compound (A) does not count as a builder (E). Examples of suitable builders (E) are silicates, especially sodium disilicate and sodium metasilicate, zeolites, sheet silicates, especially those of the formula $\alpha$-$Na_2Si_2O_5$, $\beta$-$Na_2Si_2O_5$, and $\delta$-$Na_2Si_2O_5$, succinic acid and alkali metal salts thereof, fatty acid sulfonates, $\alpha$-hydroxypropionic acid, alkali metal malonates, fatty acid sulfonates, alkyl and alkenyl disuccinates, nitrilotriacetic acid, ethylenediaminetetraacetic acid, diethylenetriaminepentaacetic acid, hydroxyethylethylenediaminetriacetic acid, iminodisuccinic acid, hydroxyiminodisuccinic acid, ethylenediaminedisuccinic acid, aspartic acid diacetic acid and salts thereof, and also carboxymethylinulin, tartaric acid diacetate, tartaric acid monoacetate, oxidized starch, and polymeric builders (E), for example polycarboxylates and polyaspartic acid.

Most preferably, formulations of the invention comprise one or polymeric builders (E). Polymeric builders (E) are understood to mean organic polymers, especially polycarboxylates and polyaspartic acid. Polymeric builders (E) have only a negligible effect, if any, as a surfactant.

In one embodiment of the present invention, polymeric builder (E) is selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is especially polyacrylic acid, which preferably has a mean molecular weight $M_w$ in the range from 2000 to 40 000 g/mol, preferably 2000 to 10 000 g/mol, especially 3000 to 8000 g/mol. Also suitable are copolymeric polycarboxylates, especially those of acrylic acid with methacrylic acid and of acrylic acid or methacrylic acid with maleic acid and/or fumaric acid.

In one embodiment of the present invention, polymeric builder (E) is selected from one or more copolymers prepared from at least one monomer from the group consisting of monoethylenically unsaturated $C_3$-$C_{10}$-mono- or dicarboxylic acids or the anhydrides thereof, such as maleic acid, maleic anhydride, acrylic acid, methacrylic acid, fumaric acid, itaconic acid and citraconic acid, and at least one hydrophilic or hydrophobic comonomer, as enumerated below.

Suitable hydrophobic monomers are, for example, isobutene, diisobutene, butene, pentene, hexene and styrene, olefins having 10 or more carbon atoms or mixtures thereof, for example 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having an average of 12 to 100 carbon atoms.

Suitable hydrophilic monomers are monomers having sulfonate or phosphonate groups and nonionic monomers having a hydroxyl function or alkylene oxide groups. Examples include: allyl alcohol, isoprenol, methoxy polyethylene glycol (meth)acrylate, methoxy polypropylene glycol (meth)acrylate, methoxy polybutylene glycol (meth) acrylate, methoxy poly(propylene oxide-co-ethylene oxide) (meth)acrylate, ethoxy polyethylene glycol (meth)acrylate, ethoxy polypropylene glycol (meth)acrylate, ethoxy polybutylene glycol (meth)acrylate and ethoxy poly(propylene oxide-co-ethylene oxide) (meth)acrylate. The polyalkylene glycols comprise 3 to 50, especially 5 to 40 and particularly 10 to 30 alkylene oxide units.

Particularly preferred sulfo-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide and salts of the aforementioned acids, for example the sodium, potassium or ammonium salts thereof.

Particularly preferred monomers containing phosphonate groups are vinylphosphonic acid and salts thereof.

In addition, one or more amphoteric polymers other than graft polymer (B) may be used as polymeric builders (E). Examples of amphoteric polymers are copolymers of at least one ethylenically unsaturated carboxylic acid, selected from acrylic acid and methacrylic acid, at least one amide, selected from N—$C_1$-$C_{10}$-alkyl(meth)acrylamide, acrylamide and methacrylamide, and at least one comonomer selected from DADMAC, MAPTAC and APTAC.

Formulations of the invention may comprise, for example, in the range from a total of 10% to 75% by weight, preferably to 50% by weight, of builder (E), based on the solids content of the formulation of the invention in question.

Formulations of the invention may comprise, for example, in the range from a total of 2% to 15% by weight, preferably to 10% by weight, of polymeric builder (E), based on the solids content of the formulation of the invention in question.

In a particularly preferred embodiment, formulation of the invention comprises, as well as graft polymer (B), a polymeric builder (E). The weight ratio of polymeric builder (E) to graft copolymer (B) in that case is preferably 30:1 to 3:1.

In one embodiment of the present invention, formulations of the invention may comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular significance as a cobuilder. It is preferably used in the form of the sodium salt, the disodium salt giving a neutral reaction and the tetrasodium salt an alkaline reaction (pH 9). Useful aminoalkanephosphonates are preferably ethylenediaminetetramethylenephosphonate (EDTMP), diethylenetriaminepentamethylenephosphonate (DTPMP) and the higher homologs thereof. They are preferably used in the form of the sodium salts that give a neutral reaction, for example of the hexasodium salt of EDTMP or of the hepta- and octasodium salt of DTPMP.

Formulations of the invention may comprise one or more alkali carriers. Alkali carriers ensure, for example, the pH of at least 9 when an alkaline pH is desired. Suitable examples are alkali metal carbonates, alkali metal hydrogencarbonates, alkali metal hydroxides and alkali metal metasilicates. A preferred alkali metal in each case is potassium, more preferably sodium.

Formulations of the invention may comprise one or more bleach catalysts. Bleach catalysts can be selected from bleach-boosting transition metal salts or transition metal complexes, for example manganese-, iron-, cobalt-, ruthenium- or molybdenum-salen complexes, or manganese-, iron-, cobalt-, ruthenium- or molybdenum-carbonyl complexes. Also usable as bleach catalysts are manganese, iron, cobalt, ruthenium, molybdenum, titanium, vanadium and copper complexes with nitrogen-containing tripod ligands, and cobalt-, iron-, copper- and ruthenium-ammine complexes.

Formulations of the invention may comprise one or more bleach activators, for example N-methylmorpholinioacetonitrile salts ("MMA salts"), trimethylammonioacetonitrile salts, N-acylimides, for example N-nonanoylsuccinimide, 1,5-diacetyl-2,2-dioxohexahydro-1,3,5-triazine ("DADHT") or nitrile quats (trimethylammonioacetonitrile salts).

Further examples of suitable bleach activators are tetraacetylethylenediamine (TAED) and tetraacetylhexylenediamine.

Formulations of the invention may comprise one or more corrosion inhibitors. This is understood in the present case to mean those compounds that inhibit the corrosion of metal. Examples of suitable corrosion inhibitors are triazoles, especially benzotriazoles, bisbenzotriazoles, aminotriazoles, alkylaminotriazoles, and also phenol derivatives, for example hydroquinone, catechol, hydroxyhydroquinone, gallic acid, phloroglucinol or pyrogallol, and also polyethyleneimine and salts of bismuth or zinc.

In one embodiment of the present invention, formulations of the invention comprise a total of in the range from 0.1% to 1.5% by weight of corrosion inhibitor, based on the solids content of the formulation of the invention in question.

Formulations of the invention may comprise one or more builder materials, for example sodium sulfate.

Formulations of the invention may comprise one or more defoamers, selected, for example, from silicone oils and paraffin oils.

In one embodiment of the present invention, formulations of the invention comprise a total of in the range from 0.05% to 0.5% by weight of defoamer, based on the solids content of the formulation of the invention in question.

In one embodiment of the present invention, formulations of the invention may comprise one or more acids, for example methanesulfonic acid.

In one embodiment, formulations of the invention comprise one or more disintegrants, also called tablet disintegrants. Examples are starch, polysaccharides, for example dextrans, and also crosslinked polyvinylpyrrolidone and polyethylene glycol sorbitan fatty acid esters.

In one embodiment of the present invention, those formulations of the invention that are liquid at room temperature comprise one or more thickeners.

In order to achieve the desired viscosity of the formulation of the invention in question, preferably one or more thickeners are added to formulations of the invention in gel form, and it is found to be particularly advantageous when the formulation of the invention in question comprises thickeners in the range from 0.1% to 8% by weight, preferably from 0.2% to 6% by weight and more preferably from 0.2% to 4% by weight, based on the solids content of the formulation of the invention in question.

Thickeners selected may be naturally occurring polymers or modified natural products or synthetic thickeners.

Examples of naturally occurring polymers suitable as thickeners in the context of the present invention include: agar agar, carrageenan, tragacanth, gum arabic, alginates, pectins, polyoses, guar flour, carob seed flour, starch, dextrins, xanthan, gelatin and casein.

Examples of thickeners from the group of the modified natural products can be selected, for example, from the group of the modified starches and celluloses. Examples include carboxymethyl cellulose and other cellulose ethers, hydroxyethyl cellulose and hydroxypropyl cellulose, and seed flour ethers.

Synthetic thickeners are selected from partly crosslinked poly(meth)acrylic acids, hydrophobically modified polyurethanes (HEUR thickeners), and poly(meth)acrylic acid copolymers esterified with fatty alcohol ethoxylates (HASE thickeners).

A thickener used with particular preference is xanthan.

In one embodiment of the present invention, formulations of the invention may comprise one or more organic solvents. For example, organic solvents can be selected from the groups of the monoalcohols, diols, triols or polyols, or the esters, ethers and amides. Particular preference is given to organic solvents that are water-soluble, "water-soluble" solvents in the context of the present application being solvents that are fully miscible with water, i.e. without a miscibility gap, at room temperature.

Organic solvents that are suitable for formulations of the invention are preferably selected from the group of mono- or polyhydric alcohols, alkanolamines or glycol ethers that are miscible with water within the concentration range specified. Preferably, organic solvents are selected from ethanol, n- or i-propanol, butanols, glycol, propane-1,2-diol, or butanediol, glycerol, diglycol, propyl- or n-butyldiglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy-, ethoxy- or butoxytriglycol, 1-butoxyethoxy-2-propanol, 3-methyl-3-methoxybutanol, propylene glycol t-butyl ether and mixtures of two or more of the aforementioned organic solvents.

In one embodiment of the present invention, formulations of the invention have a pH in the range from 6 to 14, preferably 8 to 13. In the case of those formulations of the invention that are solid at room temperature, the pH of a 1% by weight aqueous solution or of the liquid phase of a 1% by weight aqueous suspension is determined.

Formulations of the invention are of very good suitability as or for production of dishwashing compositions, especially for machine dishwashing ("automatic dishwashing" or ADW for short). Formulations of the invention themselves, and dishwashing compositions produced from formulations of the invention—especially phosphate-free dishwashing compositions produced from formulations of the invention—have very good inhibition of scale, especially on glassware, in machine dishwashing. More particularly, formulations of the invention are also effective against persistent stains.

Examples of metalware are cutlery, pots, pans and garlic presses, especially items of cutlery such as knives, cake slices and serving implements.

Examples of glassware include: glasses, glass bowls, glass dishware, for example glass plates, but also articles which have at least one glass surface and may have been decorated or be undecorated, for example glass vases, transparent pan lids and glass vessels for cooking.

Examples of plasticware include plates, cups, beakers and bowls made from melamine, polystyrene and polyethylene.

Examples of porcelainware include plates, cups, beakers and bowls made from porcelain, white or colored, each with or without decoration.

The present invention therefore further provides for the use of formulations of the invention for washing dishware and kitchen utensils, especially for machine dishwashing, i.e. for washing with a machine dishwasher. The present invention further provides a process for machine dishwashing using at least one formulation of the invention, also called dishwashing process of the invention in the context of the present invention. For performance of the dishwashing process of the invention, the procedure may be to contact dishware or kitchen utensils with an aqueous solution or suspension comprising at least one formulation of the invention. After the contacting, the formulation can be left to act. This is followed by removal of the liquor thus obtainable, rinsing once or more than once with preferably clear water and leaving the ware to dry.

In one embodiment of the present invention, cleaning is accomplished using water having a hardness in the range from 1 to 30° dH, preferably 2 to 25° dH, German hardness (dH) being understood to mean more particularly the sum of magnesium hardness and calcium hardness.

In a particular variant of the dishwashing process of the invention, neither regenerating salt nor separate rinse aid is used.

The present invention further provides a process for producing formulations of the invention, also called production process of the invention in the context of the present invention. The production process of the invention comprises mixing at least one compound (A), at least one graft copolymer (B) and optionally one or more further ingredients (E) and optionally peroxide (D) or chlorine bleach (D) with one another in one or more steps, optionally in the presence of water, and then optionally wholly or partially removing water.

Compound (A), graft copolymer (B), peroxide (D) and further ingredients (E) have been described above.

In another embodiment of the present invention, compound (A), one or more further ingredients (E) and optionally peroxide (D) are mixed in dry form and then an aqueous solution of graft copolymer (B) is added, either outside or within a machine dishwasher.

In another embodiment of the present invention, compound (A), graft copolymer (B) and one or more further ingredients (E) and optionally peroxide (D) or chlorine bleach (D) are mixed in dry form and the mixture thus obtained is compressed to shaped bodies, especially to tablets.

In one embodiment of the present invention, the at least partial removal of the water may be preceded by mixing with one or more further ingredients (E) for formulation of the invention, for example with one or more surfactants, one or more enzymes, one or more enzyme stabilizers, one or more builders (E), preferably one or more phosphate-free builders (E), especially one or more polymeric builders (E), one or more cobuilders, one or more alkali carriers, one or more bleach catalysts, one or more bleach activators, one or more bleach stabilizers, one or more defoamers, one or more corrosion inhibitors, one or more builder materials, with buffer or dye.

In one embodiment, the procedure is to remove the water wholly or partly from formulation of the invention, for example down to a residual moisture content in the range from zero to 15% by weight, preferably 0.1% to 10% by weight, by evaporating it, for example by spray drying, spray granulation or compaction.

In one embodiment of the present invention, the water is removed wholly or partly at a pressure in the range from 0.3 to 2 bar.

In one embodiment of the present invention, the water is removed wholly or partly at temperatures in the range from 60 to 220° C.

In another embodiment, the water is not removed. Instead, further water can be added. More preferably, a thickener is also added. In this way, liquid formulations of the invention can be obtained. At room temperature, liquid formulations of the invention may, for example, be in gel form.

Through the production process of the invention, it is easily possible to obtain formulations of the invention.

The formulations of the invention may be in liquid or solid form, in mono- or polyphasic form, as tablets or in the form of other dosage units, for example of pouches, in packaged or unpackaged form.

The invention is elucidated by working examples.

EXAMPLES

I. Production of Inventive Formulations and of Comparative Formulations

In the context of the present application, figures in % are percent by weight, unless explicitly stated otherwise.

Graft copolymer (B.1) corresponds to graft copolymers (B.4) from WO 2015/197379. It was prepared as follows:

Comonomers Used:

(a.1): maltodextrin, commercially available as Cargill C*Dry MD01955

(b.1): acrylic acid (c.1): [2-(methacryloyloxy)ethyltrimethylammonium chloride ("TMAEMC")

Preparation of Graft Copolymer (B.1)

A stirred reactor was initially charged with 220 g of (a.1) in 618 g of water and heated to 80° C. while stirring. At 80° C. the following solutions were metered in simultaneously and via separate feeds as follows:

a) an aqueous solution of 40.6 g of (c.1) in 149 g of water, within 4 hours.

b) a solution of 9.85 g of sodium peroxodisulfate in 68.0 g of water within 5 h, beginning simultaneously with the metered addition of a).

c) a solution of 32.8 g (b.1) and 36.5 g of sodium hydroxide solution (50% in water), diluted with 139 g of water, within 2 hours, beginning 2 hours after commencement of metered addition of a).

On completion of addition of solutions a) to c), the reaction mixture was stirred at 80° C. for one hour. Subsequently, a solution of 0.73 g of sodium peroxodisulfate in 10.0 g of water was added and the mixture was stirred at 80° C. for a further 2 hours. Subsequently, the mixture was cooled to room temperature and 8 g of biocide were added. A 22.4% by weight solution of graft copolymer (B.1) was obtained.

The biocide used was a 9% by weight solution of 1,2-benzisothiazolin-3-one in water-propylene glycol mixture, commercially available as Proxel™ XL2 Antimicrobial. Stated amounts are tell quel.

Inventive formulations F.1 and comparative formulations C-F.2 to C-F.4 were produced by dry mixing the components according to table 1—except for surfactant 1. Nonionic surfactant 1 was melted and stirred into the dry mixture and in this way distributed with maximum homogeneity. If graft copolymer (B.1) was in the form of an aqueous solution, the graft copolymer was first isolated by drying and added in solid form to the other solid components or separately as a solution to the machine dishwasher. The components of the inventive formulation F.1 and comparative formulations C-F.2 to C-F.4 are apparent from table 1.

TABLE 1

Composition of inventive formulation F.1 and comparative formulations C-F.2 to C-F.4

| Constituent [g] | F.1 | C-F.2 | C-F.3 | C-F.4 |
|---|---|---|---|---|
| (A.1) | 35 | 35 | 35 | 35 |
| (B.1) | 1 | 0 | 1 | |
| (C.1) | 0 | 0 | 10 | 10 |
| Polymeric builder (E.1) | 4 | 4 | 4 | 4 |
| (D.1) | 10.2 | 10.2 | 10.2 | 10.2 |
| Nonionic surfactant 1 | 4 | 4 | 4 | 4 |
| Nonionic surfactant 2 | 1 | 1 | 1 | 1 |
| Protease | 2.5 | 2.5 | 2.5 | 2.5 |
| Amylase | 1 | 1 | 1 | 1 |
| $Na_2Si_2O_5$ | 2 | 2 | 2 | 2 |
| TAED | 4 | 4 | 4 | 4 |
| $Na_2CO_3$ | 34.5 | 34.5 | 24.5 | 24.5 |
| HEDP | 0.8 | 0.8 | 0.8 | 0.8 |
| $ZnSO_4$ as heptahydrate | 0.2 | 0.2 | 0.2 | 0.2 |

Key:

(A.1): trisodium citrate dihydrate, corresponding to active content 30.7 g (C.1): MGDA-$Na_3$, racemic, corresponding to active content 8 g (D.1): sodium percarbonate, 2 $Na_2CO_3$•3 $H_2O_2$ Nonionic surfactant 1: n-$C_8H_{17}$—CH(OH)—$CH_2$—O—$(EO)_{22}$—CH($CH_3$)—$CH_2$—O—n-$C_{10}H_{21}$ Nonionic surfactant 2: n-$C_{10}H_{21}$—CH(OH)—$CH_2$—O—$(EO)_{40}$—n-$C_{10}H_{21}$ $Na_2Si_2O_5$: commercial in the form of Britesil ® H 265 LC HEDP: 1-hydroxyethane-1,1-diphosphonate disodium salt Polymeric builder (E.1): random acrylic acid/2-acrylamido-2-methylpropanesulfonic acid copolymer as sodium salt, fully neutralized, comonomer ratio 70:30 (% by weight), K value 40 (Fikentscher).

II. Tests for Determination of Glass Corrosion

Machine dishwasher: Miele G 1222 SCL

Program: 65° C. (with prewash)

Ware: 3 "GILDE" sekt glasses, 3 "INTERMEZZO" schnapps glasses

For washing, the glasses were arranged in the upper dishware basket of the machine dishwasher. The dishwashing detergent used in each case was 18 g of inventive formulation or comparative formulation according to table 1. A rinsing temperature of 65° C. was used. The water hardness in each case was in the range from zero to 2° dH. 50 rinse cycles in each case were used, meaning that the program was left to run 50× in succession. The evaluation was effected by gravimetry and by visual means after 50 wash cycles.

The weight of the glasses was determined prior to commencement of the first wash cycle and after the drying after the last wash cycle. The weight loss is the difference between the two values.

As well as the gravimetric evaluation, a visual assessment of the ware after 50 cycles was carried out in a darkened chamber under light behind an aperture using a grading scale from 1 to 5; see below. Grades were determined in each case for areal corrosion/cloudiness and for linear corrosion.

The results according to table 2 were obtained.

TABLE 2

Glass corrosion experiments

| | F.1 | C-F.2 | C-F.3 | C-F.4 |
|---|---|---|---|---|
| Weight loss of sekt glasses (mg) | 10 | 29 | 56 | 75 |
| Weight loss of schnapps glasses (mg) | 6 | 16 | 32 | 46 |
| Linear corrosion of sekt glasses | L4.5 | L3.0 | L3.0 | L3.0 |
| Cloudiness of sekt glasses | T5.0 | T5.0 | T4.0 | T3.5 |
| Linear corrosion of schnapps glasses | L4.5 | L4.0 | L1.5 | L1.0 |
| Cloudiness of schnapps glasses | T5.0 | T5.0 | T1.5 | T3.0 |

The assessments were made according to the following scheme:

Linear Corrosion:

L5.0: no discernible lines

L4.0: slight line formation in very few regions, fine linear corrosion

L3.0: linear corrosion in a few regions

L2.0: linear corrosion in several regions

L1.0: severe linear corrosion

Cloudiness

T5.0: no discernible cloudiness

T4.0: slight cloudiness in very few regions

T3.0: cloudiness in a few regions

T2.0: cloudiness in several regions

T1.0: severe cloudiness over almost the entire glass surface

In the inspection, intermediate grades (e.g. L4.5) were also permitted.

Test Method for Inhibition of Scale

All washing tests were conducted in a Miele G1222 SCL machine dishwasher. The program with 65° C. for the wash cycle and 65° C. for the rinse cycle was selected. The tests were conducted with hardened water having a water hardness of 21° dH (Ca/Mg):$HCO_3$ (3:1):1.35. No separate rinse aid was added, and the installed water softener (ion exchanger) was not regenerated with regenerating salt. For each rinse cycle, a dose of 18 g of the inventive formulation specified was used. At the start of every wash cycle, 50 g of a ballast soil consisting of grease, protein and starch were added.

To assess the inhibition of scale, a total of 30 successive wash tests were conducted with the same test ware. The test ware used in each wash test was stainless steel knives, blue melamine plates, drinking glasses and porcelain cups. Between every two wash cycles, there was a delay of one hour, with the machine dishwasher door closed for 10 min thereof and opened for 50 min thereof.

For each wash test, a dose of 18 g of the inventive formulation or comparative formulation specified was used. At the start of each and every wash cycle, in addition, 50 g of a ballast soil consisting of grease, protein and starch were added.

After the 30th wash cycle had ended, the test ware was inspected visually in a darkened chamber under light behind an aperture and assessed with regard to spots, streaks and film-like deposits according to a grade scale from 1 (=severe residues) to 10 (=no residues); see table 3.

TABLE 3

Formation of scale, spots and streaks

| | Knives | Glasses | Melamine plates | Porcelain |
|---|---|---|---|---|
| F.1 | 6.0 | 5.0 | 6.0 | 5.0 |
| C-F.2 | 4.0 | 4.0 | 4.3 | 4.7 |

The invention claimed is:

1. A formulation comprising (A) citric acid or an alkali metal salt of citric acid, (B) at least one graft copolymer formed from (a) at least one graft base selected from nonionic monosaccharides, disaccharides, oligosaccharides and polysaccharides, and side chains, obtainable by grafting of (b) at least one ethylenically unsaturated mono- or dicarboxylic acid and (c) at least one compound of the general formula (I)

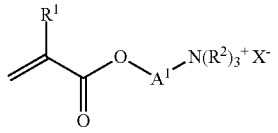

(I)

wherein the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate, and (C) a total of zero to 0.5% by weight of methylglycinediacetic acid (MGDA) and glutaminediacetic acid (GLDA) and alkali metal salts of MGDA and GLDA.

2. The formulation according to claim 1, which is free of phosphates and polyphosphates.

3. The formulation according to claim 1, wherein compound (c) is selected from ω-trimethylaminoethyl(meth) acrylatochloride.

4. The formulation according to claim 1, wherein compound (A) is selected from the trisodium salt of citric acid.

5. The formulation according to claim 1, which is solid at room temperature.

6. The formulation according to claim 1, further comprising at least one inorganic peroxide compound (D).

7. The formulation according to claim 1, further comprising at least one polymeric builder (E).

8. The formulation according to claim 1, comprising:

a total of 1% to 50% by weight of compound (A), a total of 0.1% to 4% by weight of graft copolymer (B), based on the solids content of the formulation.

9. A method for washing dishware and kitchen utensils, the method comprising using the formulation according to claim 1 for washing the dishware and the kitchen utensils.

10. A method for washing articles having at least one glass surface which has been decorated or is undecorated, the method comprising using the formulation according to claim 1 for washing the articles.

11. The method according to claim 9, wherein the washing is effected with a machine dishwasher.

12. A process for producing the formulation according to claim 1, comprising mixing at least one compound (A) and at least one graft copolymer (B) and optionally one or more further ingredients (F) and optionally peroxide (D) or chlorine bleach (D) with one another in one or more steps, optionally in the presence of water, and then optionally wholly or partially removing water.

13. The process according to claim 12, wherein the water is removed by spray drying.

14. The method according to claim 10, wherein the washing is effected with a machine dishwasher.

* * * * *